United States Patent [19]

Mattsson

[11] Patent Number: 4,463,656

[45] Date of Patent: Aug. 7, 1984

[54] PNEUMATIC MOTOR DRIVE

[75] Inventor: Per-Arne Mattsson, Blidsberg, Sweden

[73] Assignee: Verktygsindustrie I Blidsberg AB, Blidsberg, Sweden

[21] Appl. No.: 339,125

[22] Filed: Jan. 13, 1982

[30] Foreign Application Priority Data

Jan. 16, 1981 [SE] Sweden ..... 8100239

[51] Int. Cl.[3] ..... F01B 25/04

[52] U.S. Cl. ..... 91/20; 91/32; 91/446; 91/448

[58] Field of Search ..... 91/32, 20, 16

[56] References Cited

U.S. PATENT DOCUMENTS

| | | | |
|---|---|---|---|
| 2,660,955 | 12/1953 | Kent et al. | 91/20 |
| 2,682,749 | 7/1954 | Pinsenschaum | 91/20 |
| 2,692,583 | 10/1954 | Neckel et al. | 91/20 |
| 3,405,522 | 10/1968 | Tomita | 60/456 |

FOREIGN PATENT DOCUMENTS

| | | |
|---|---|---|
| 1949712 | 6/1970 | Fed. Rep. of Germany . |
| 2509712 | 9/1975 | Fed. Rep. of Germany . . |
| 2273965 | 1/1976 | France . |
| 367461 | 9/1971 | Sweden . |
| 649571 | 4/1979 | U.S.S.R. . |

OTHER PUBLICATIONS

"Kombinationsbuch für Pneumatische Steuerungen" by Konrad Ziesling, vol. 10 of the book series, olhydraulic and peaumatic, Krausskopf-Verlag, Mainz 1968, Group numbers 1-4 and Nos. 28 and 42.

*Primary Examiner*—Paul E. Maslousky
*Attorney, Agent, or Firm*—Fred Philpitt

[57] ABSTRACT

For supplying a compressible driving fluid, preferably air, under pressure from a source to a motor of the kind comprising a housing, in which a body is reciprocable between predetermined end positions while dividing the interior of the housing into two chambers alternatingly serving as fluid receiving chambers, a drive system composed of conventional valves and other circuit components is provided, which assures that the driving fluid is supplied to the pressure chamber at a reduced pressure during the finishing phase of each operating stroke of the motor. The source is presupposed to deliver the compressible fluid under a pressure substantially exceeding the fluid pressure required for driving the motor under its anticipated maximum load.

5 Claims, 9 Drawing Figures

PNEUMATIC MOTOR DRIVE

BACKGROUND OF THE INVENTION

The present invention is concerned with a system for supplying a compressible driving fluid to a motor of the kind comprising a housing, in which a body is reciprocable between predetermined end positions while dividing the interior of the housing into two chambers alternatingly serving as pressure chambers and receiving driving fluid from a source having a minimum pressure which substantially exceeds the fluid pressure required for driving the motor under its anticipated maximum load.

Typical examples of motors of the kind here in question are double-acting linear or rotary motors driven by compressed air, or any other gaseous fluid under pressure, in which said body is a reciprocating piston, an oscillating vane or some kind of slide, runner or the like being sealingly movable in a housing and commonly being connectable to the load to be moved. The path along which the body is moving may be rectilinear, curved or of practically any other bending or partially curved and partially rectilinear shape, provided that it permits a generally unimpeded passage of the body between the end positions. Of course, the invention is equally applicable to motors of the general kind just referred to, in which the piston or body is kept stationary whereas the housing is movable and adapted to be connected to the load.

It is essential to the invention that the source of driving fluid is not only capable of temporarily supplying the minimum pressure but also has such a large capacity in relation to the consumption of the motor that a possible pressure drop in the source during and as a result of the operation of the motor is negligible. A typical example is that the motor is driven by compressed air from a compressor unit, the capacity of which in a conventional manner is adapted to be very well sufficient for the need of the motor and, possibly, also of additional consumers connected to the compressor.

Assume for the sake of simplicity and as an example only that the motor is a compressed-air-operated, double-acting cylinder which is used for moving a load between two stations, perhaps a sliding door between closed and open positions—in which case the load is the same in both the two directions of movement—or a gripping device between a load-fetching position and a load-depositing position—in which case the load is different in the two directions of movement. Also assume, likewise only as an example, that at disposal is a compressor plant, the capacity of which so considerably exceeds the maximum consumption of the cylinder at continuous work with the highest possible speed that the risk of a pressure drop in the pressure source as a result of the consumption of the cylinder is non-existent, and that the compressor plant supplies a minimum pressure of say 800 kPa, whereas the cylinder is capable, even if only with the lowest operating speed, to carry out its intended operation at a driving fluid pressure of say 600 kPa.

In such a case the expert would probably without hesitation connect the cylinder to the compressor plant in the simpliest way, namely through a conventional directional valve, which, according to need, is either manually or automatically controlled, perhaps through a remote control circuit, and, of course, choose a cylinder with a well known fixed or variable damping, i.e. with automatic deceleration of the piston movement, adjacent the two end positions. The result would then be that the air consumption of the cylinder per time unit—disregarding possible minor leakages—is the product of the cylinder volume, the number of piston strokes performed during the selected time unit, and the conversion factor, about 8, which is required for transforming the result into normal atmospheric pressure. Possibly, although with less probability, the expert in order to reduce the air consumption would also put in a pressure regulator set at a value of 600–700 kPa before the directional valve in order to thereby correspondingly reduce the conversion factor. This, however, unavoidably results in a reduction also of the operational speed of the cylinder, i.e. an increase of the time required for the completion of each piston stroke.

SUMMARY OF THE INVENTION

The object of the present invention is to disclose a system or an arrangement of the kind referred to in the introduction, which in most applications permits a frequently considerable saving of driving fluid under pressure—and, consequently, of energy consumed for the operation of the motor—while in any case maintaining and in many cases even increasing the operating speed of the motor which the excess pressure available at the driving fluid source is capable of producing, when it is used unreduced for driving the motor. This advantageous and surprising effect of the invention is mainly based on the fact that the conditions for the acceleration of the movable body or housing of the motor are improved, but also on the fact that the inertia, or more specifically the kinetic energy, of the movable motor member, and whereever applicable, of the load driven thereby, is at least partially recovered during the operating strokes of the motor.

The main characteristic feature of the system according to the invention is that it comprises means for supplying during a finishing phase of each stroke the driving fluid from the source to that chamber of the motor, which for the time being serves as a pressure chamber, at a lower pressure than during the initial phase of the same stroke. Thereby it is achieved that the pressure in the pressure chamber in question at the end of the stroke is considerably lower than the pressure of the fluid, which during the initiation of the next operating stroke is supplied to the other chamber of the motor, which then becomes the pressure chamber. This results in an increased acceleration of the movable motor member in the opposite direction of stroke. At the same time the need of damping, i.e. of a deceleration of the movable motor member, adjacent its end positions, and hence also of a most frequently unprofitable transformation of kinetic energy into heat, which may only seldom take place without wear of the components, is reduced.

Among the further features of the invention, which will more closely appear from the following subclaims, the composition of the beforementioned means for the temporary lowering of the pressure of the driving medium supplied to the pressure chamber during the finishing phase of the stroke is of particular importance, because it makes it possible to use already known standard components easily available on the open market and having, as a result of competition between various manufacturers a high quality at reasonable prices, which components in addition in their preferred form give the system a simplicity and an accompanying reliability which is valuable not least from the viewpoint of manufacture and service.

BRIEF DESCRIPTION OF THE DRAWINGS

For elucidating the invention two embodiments thereof, which are both shown in the form of simple circuit diagrams, will be described in the following and with reference to the accompanying drawings. In the drawings

FIG. 8 shows the same system in a stage, in which the piston is approaching but has not yet fully reached its left hand end position, which is the one shown in FIG. 1 and from where the operating cycle is repeated, while

Figure 1:
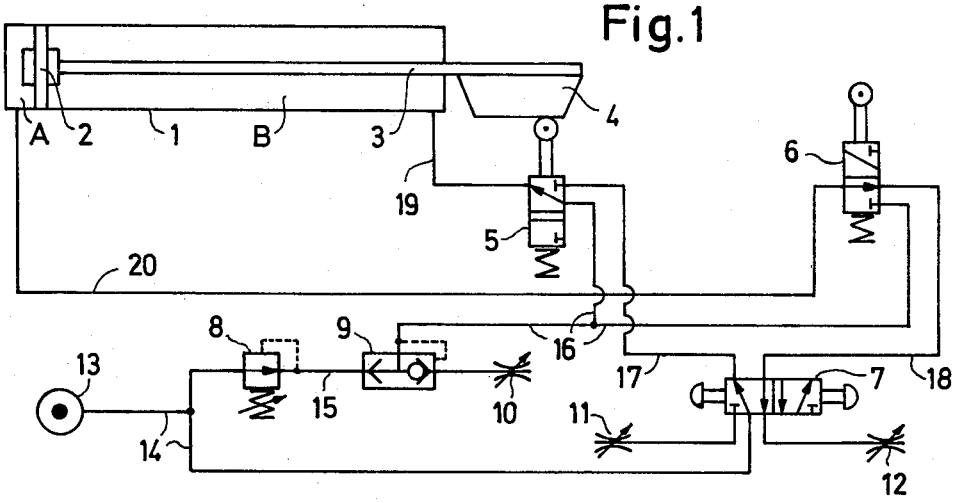
FIG. 1 illustrates a first system in a stage, in which a previous piston stroke towards the left in the figure has been terminated whereas a subsequent piston stroke towards the right has not yet begun.

It should be clear that the stages shown in FIGS. 5–8 in the operation of the first system differ from the ones shown in FIGS. 1–4 only by the changed positions of certain valves in the system caused by the reversed direction of movement of the piston. Also it should be clear that in the operation of the system shown in FIG. 9 generally the same series of stages can be discerned as in the first system.

DESCRIPTION OF THE PREFERRED EMBODIMENTS

The first system shown in FIGS. 1 to 8 inclusive comprises primarily a double acting cylinder 1 having a conventional deceleration arrangement of any arbitrary kind at both ends and having a piston 2 with a piston rod 3. Outside the cylinder housing the piston rod is provided with a control cam 4 which mechanically actuates a pair of identical two-position valves 5 and 6 having spring return. The piston 2 is, of course, assumed to be connected to a load to be driven in an arbitrary known manner, not shown.

However, it is to be noted that the piston-cylinder-device 1–3 illustrated in the drawings serves only as a symbol for any motor of the kind, in which a body under the actuation of a driving fluid supplied under pressure is movable back and forth along an arbitrary path between a pair of predetermined end positions, and that the direct mechanical actuation of the control cam 4 on the two valves 5 and 6 is solely intended to illustrate the existence of such a connection between the said motor and valves that the latter are in one way or another controlled in dependence of the position of the movable body within the motor.

Thus the symbol 1–3 may as well represent a so called turning motor, i.e. a rotary motor having a limited angle of rotation, in which case the control of the valves 5 and 6 may e.g. take place by means of a cam disc secured to the shaft of the turning motor. It may also represent a linear motor having a diaphragm or any other form of movable impact member for the driving fluid, a cylinder having a double end rod and double control cams, one for each valve, etcetera. In a further alternative the piston may, in a manner likewise known per se, take the form of a runner or slide, which is movable in a bore having a longitudinally extending slit, through which a member connected to the runner protrudes but which for the rest is kept closed by means of sealing elements bending away laterally or being of a slidable curtain-like type, in which case the projecting member connected to the runner may be utilized for controlling the valves 5 and 6.

Further, the control of the valves, of course, does not need to take place directly and mechanically as shown in the drawings, but any known forms of indirect control through e.g. electric, hydraulic or pneumatic remote control circuits may come into question and in many cases be preferred in practice. Thus the important thing is that the valves 5 and 6 are controlled in depence of the movements of the piston 2, or its equivalent, and that the moments of time during which the respective valve is thereby retained in its one operative position may be adapted, in one way or the other, to the real need, which in the diagrammatically illustrated example takes place by adaptation of the active length of the control cam 4 and the positions of the valves 5 and 6 in relation to the path of movement of the control cam.

Each of the valves 5 and 6 has three functional connections and are of such a nature that one of the said connections, which is connected to the corresponding end of the cylinder 1, in the one valve position, in which the valve is actuated by the control cam, is connected to only one of the two remaining connections, whereas the second one of said remaining connections is blocked, and in the second valve position, in which the valve is not actuated by the control cam, is connected to only the second one of the two remaining connections, whereas instead the first mentioned one of them is blocked.

In addition to the two mentioned two-position valves 5 and 6 there is included in the system of FIGS. 1 to 8 inclusive a directional valve 7, which has been illustrated as a two-position valve manually shiftable between its two positions, but which may also, in case of need, be remotely controlled. The valve 7 actually serves as an initiator of the individual piston strokes and may, if so desired, in a manner known per se be so formed and controlled by the piston movement that the piston strokes automatically follow each other either in such a manner that the piston stops only in its one end position or continues its reciprocating movement until the supply of control signals from the circuit sensing the piston movement is interrupted.

Further, the system includes a pressure regulator 8, which in the example shown is assumed to be of the kind permitting adjustment of the outlet pressure, although this, of course, is not always required, as well as a so called quick release valve 9, i.e. a kind of pressure controlled shuttle valve which at a given pressure increase at its outlet (the central connection in the symbol) in relation to the pressure at its inlet (the left hand connection in the symbol) puts the outlet in connection with the atmosphere, in the present case through a restriction 10, which is preferably adjustable. Two additional and similar restrictions 11 and 12 are connected to alternately active outlets of the directional valve 7. The three restrictions 10, 11 and 12 have for their primary task to reduce the speed of the piston during the stroke and may thus in certain cases be entirely dispensed with.

The symbol 13 designates a source of a compressible fluid, preferably air, under a pressure, which is permanently maintained substantially higher—preferably 20–30% higher—than the driving fluid pressure required in the cylinder 1 for moving the piston 2 and the load connected thereto. For example, this source may be a compressor unit of a known design having such a large capacity in relation to the consumption of the piston-cylinder-device that possible pressure drops in the source during and as a result of each individual piston stroke is negligible. Through a branched feeding line 14 the pressure source 13 is connected on the one hand to the directional valve 7 and on the other hand to the pressure regulator 8, the outlet of which is connected to the inlet of the quick release valve 9 through the conduit 15, in which the pressure is thus lower than in the source. From the outlet of the valve 9 entends a conduit 16 having two branches connecting to respective ones of the two valves 5 and 6. On the other hand, two separate conduits 17 and 18 extend from the directional valve 7, one to each of the two valves 5 and 6. The valve 5 is in turn connected to one end of the cylinder 1 through a conduit 19, whereas a corresponding conduit 20 connects valve 6 to the opposite end of the cylinder.

It should be clear that the piston 2 divides the interior of the cylinder 1 into two chambers A and B, respectively, of reciprocally varying volumes alternatingly serving as pressure chambers during the operation of the piston-cylinder-device. The one valve 5 then controls the inflow and outflow of fluid through the conduit 19 to and from the one, B, of these two chambers, whereas the other valve 6 controls the inflow and outflow of fluid through the conduit 20 to and from the other chamber A. This takes place in such a manner that the stages illustrated in the various drawing figures are discernable during each cycle of operation in the sequence indicated by the numbers of the figures.

In FIG. 1 a previous piston stroke towards the left is completed and the piston 2 occupies, after conventional deceleration, its left hand end position in the cylinder 1, in which the chamber A now has a minimum volume and is essentially emptied through the conduit 20, the unactuated valve 6, the conduit 18, the directional valve 7, and the restriction 12 to the atmosphere. On the other hand, the chamber B, which during the immediately preceding piston stroke served as a pressure chamber, has a maximum volume and is filled with driving fluid as a result of being through the conduit 19, the actuated valve 5, the conduit 16, the quick release valve 9, and the conduit 15 in open communication with the outlet side of the pressure regulator 8. Accordingly, in the chamber B there now exists a reduced pressure determined by the valve 8. It is to be noted that in the situation shown in FIG. 1 the valve 5 has been actuated for a certain period of time, the minimum of which is determined by the active length of the control cam 4 and the piston speed during the final phase of the earlier piston stroke.

Figure 2:
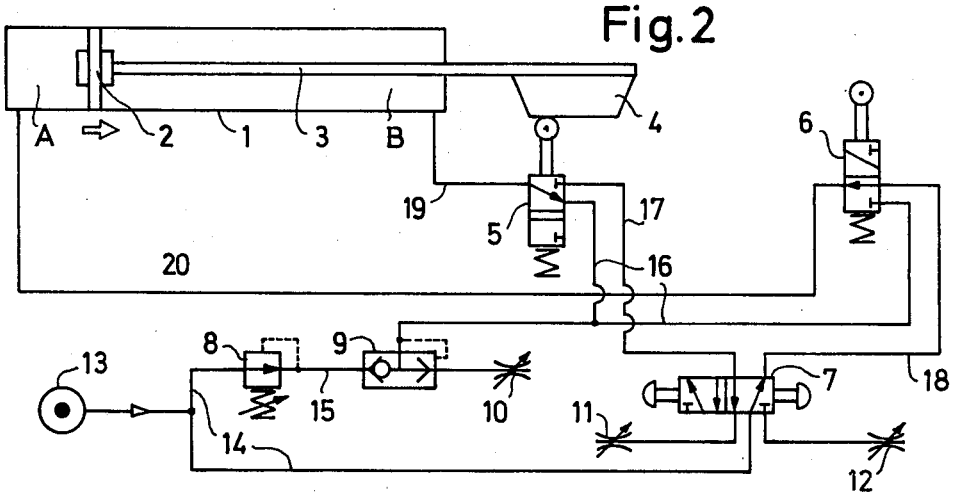
FIG. 2 shows the same system in a stage, in which the piston stroke towards the right has recently been initiated.

The position of the piston 2 in FIG. 1 is stable, because, as previously mentioned, in the example shown a manual shifting of the directional valve 7 is required for starting the next piston stroke towards the right in the figures. This shifting has just been carried out in FIG. 2, where the piston 2 and, hence, also the control cam 4 have already moved a short distance towards the right from their left hand end positions illustrated in FIG. 1 - however, not more than that the control cam 4 is still actuating the valve 5. In the situation of FIG. 2, as a result of the shifting of the valve 7, a communication has been opened from the pressure source 13 through the feeding line 14, the directional valve 7, the conduit 18, the unactuated valve 6, and the conduit 20 to the left hand end of the cylinder, whereby the chamber A, which now serves as a pressure chamber, receives driving fluid with maximum pressure, i.e. with only a pressure drop in relation to the pressure at the source 13, which is caused by the valves and conduits and is fairly negligible in practice.

At the same time the fluid remaining in the chamber B with its considerably lower pressure is driven out through the conduit 19, the still actuated valve 5, and the conduit 16 to the quick release valve 9, which has been opened to the atmosphere through the restriction 10 as a result of the fact that the pressure in the chamber B under the influence of the moving piston has been increased and now exceeds the pressure on the outlet side of the pressure regulator 8. Thereby the inlet of the valve 9 connected to the conduit 15 has also become blocked. Thanks to the substantial initial pressure difference between the chambers A and B, the inertia of the piston 1 at the start is now more easily overcome, and the piston will accelerate more rapidly than had the chamber B been filled from the beginning with fluid having a higher pressure corresponding to the one supplied to the chamber A.

Figure 3:
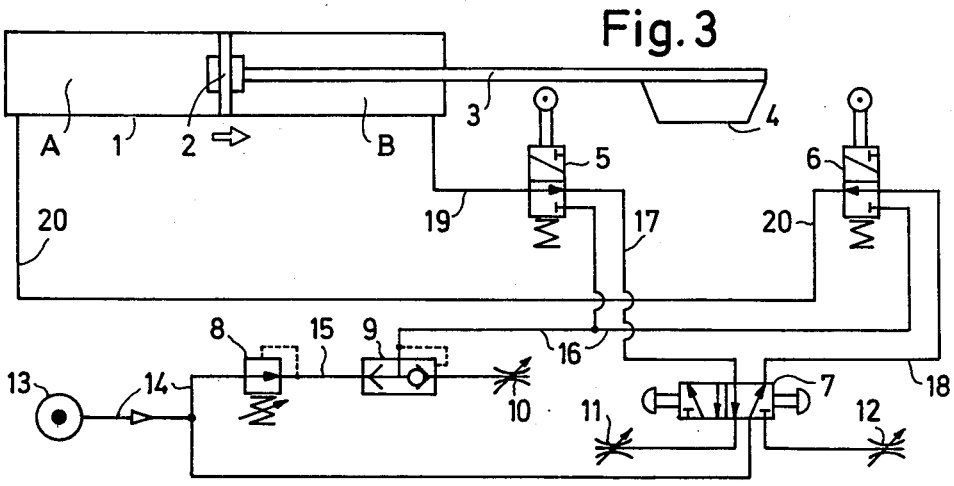
FIG. 3 shows the same system in a stage, in which the piston has advanced about half way towards its right hand end position.

After a certain first part of the stroke has been completed by the piston 1 during a period of time, the duration of which depends of the active length of the control cam 4 and the piston speed, the control cam will cease acting on the valve 5, and the situation will be the one illustrated in FIG. 3. Here the two valves 5 and 6 are unactuated, the quick release valve 9 has returned to its initial position as a result of the fact that the pressure in the conduit 15 is again dominating, and the supply of driving fluid from the pressure source 13 to the chamber A of the cylinder 1, the pressure chamber, as well as the return fluid outflow from the chamber B to the atmosphere take place through the directional valve 7. Now the return fluid flows out into the atmosphere through the restriction 11. The operational conditions for the piston-cylinder-device 1, 2 during this part of the piston stroke are generally the same as in a conventional system.

Figure 4:
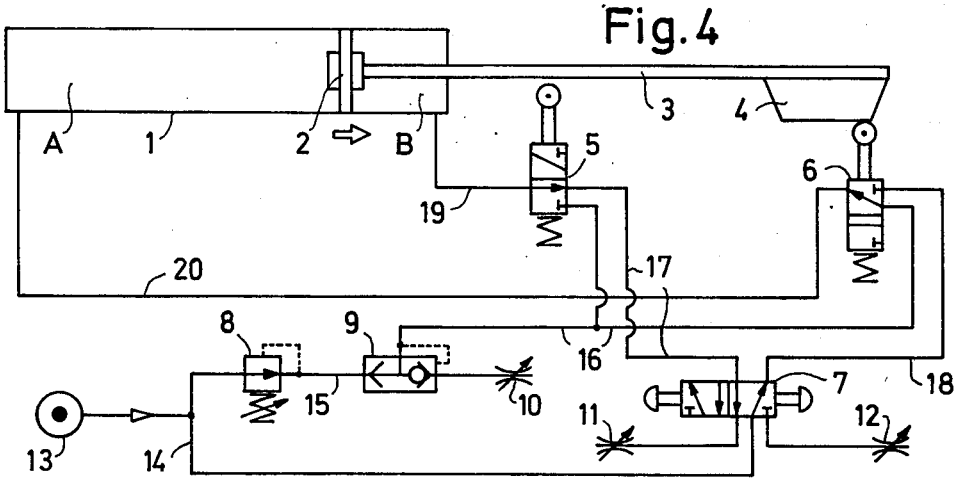
FIG. 4 shows the same system in a stage, in which the piston is approaching its right hand end position.
Figure 5:
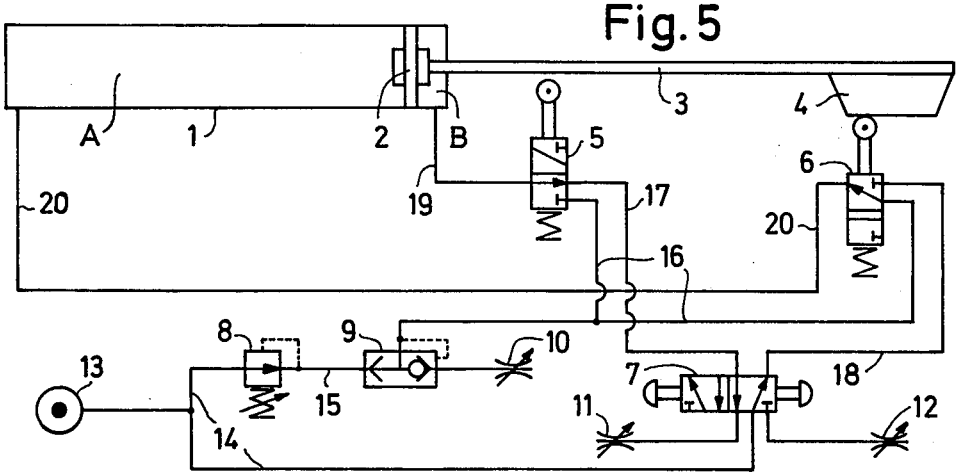
FIG. 5 shows the system of FIG. 1 in a stage, in which the piston has reached and is at standstill in its right hand end position.
Figure 6:
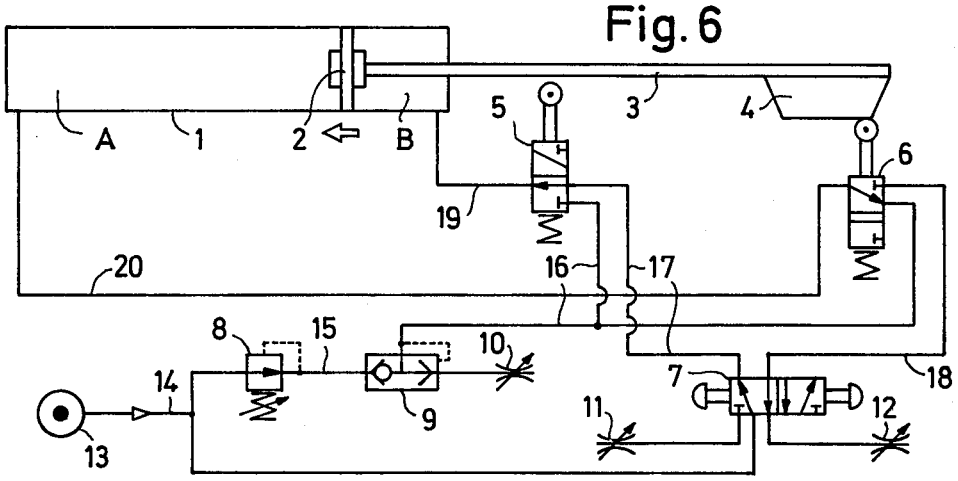
FIG. 6 shows the same system in a stage, in which the next piston stroke towards the left has recently been initiated and has begun.
Figure 7:
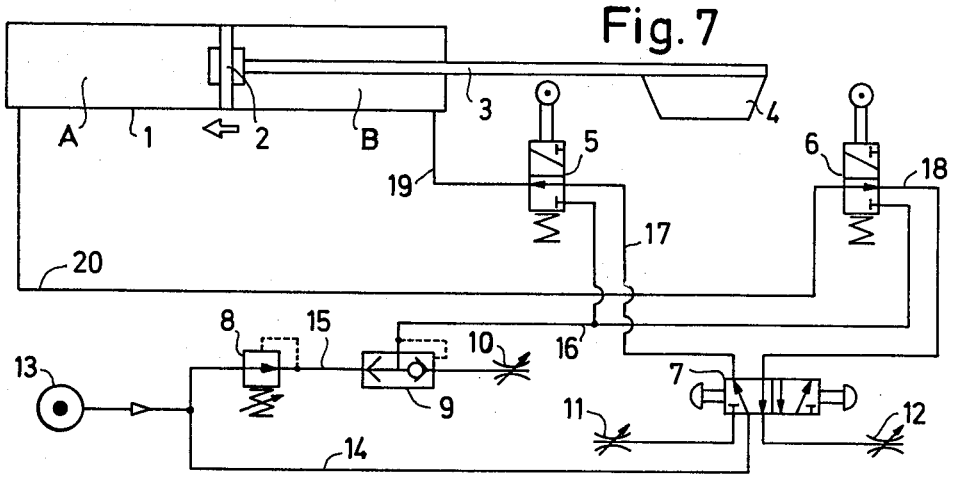
FIG. 7 shows the same system in a stage, in which the piston has passed approximately half way in its movement back to the starting position.
Figure 8:
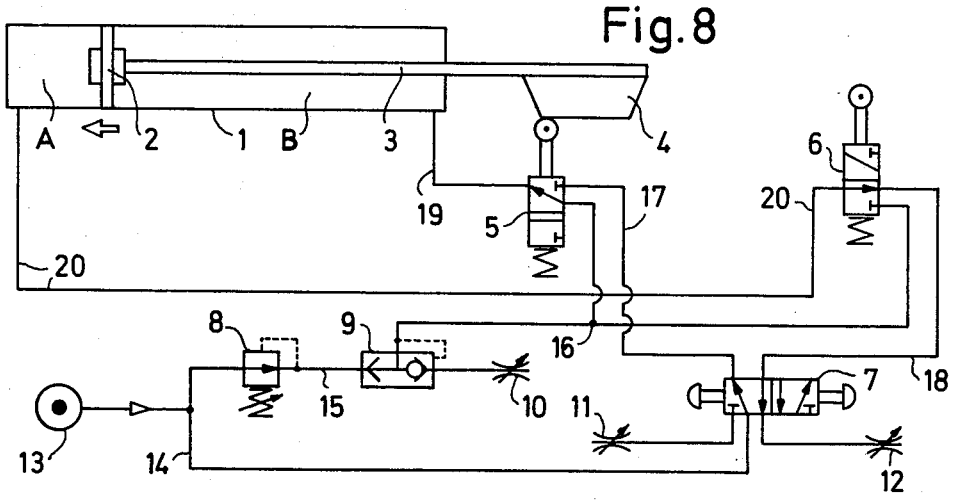

When the piston 1 during its continued stroke approaches its right hand end position, the situation will be the one shown in FIG. 4, where the control cam 4 has just caused a shifting of the valve 6. As a result, the supply of driving fluid to the cylinder chamber A no longer takes place through the directional valve 7 but instead through the pressure regulator 8 and the quick release valve 9, the outlet of which to the atmosphere is now closed. On the other hand, the outflow of return fluid from the cylinder chamber B still takes place through the directional valve 7 and the restriction 11. The valve positions shown in FIG. 4 are maintained all up to the moment, when the piston 2 after a more or less rapid deceleration caused by the decelerating arrangement of the cylinder 1 itself arrives at and stops in its right hand end position. When this end position, which generally corresponds to the left hand piston end position shown in FIG. 1, has been reached, the valve 6 has been actuated by the control cam 4 during a period of time, the duration of which again depends on the active length of the control cam 4, i.e. the length of the part of the control cam passing over the actuating member of the valve 6, and on the piston speed.

During this period of time not only the pressure of the driving fluid that can be supplied to the cylinder chamber A from the source 13 is reduced by means of the pressure regulator 8, but at the same time the quick release valve 9 operates as a kind of relief valve, namely if the pressure in the chamber A exceeds the outlet pressure from the valve 8. Thereby is assured that, when the piston stops in its end position shown in FIG. 5, the pressure in the chamber A will be the same as, or only insignificantly higher than, the outlet pressure from the pressure regulator 8. Of course, the magnitude of this pressure should preferably be chosen so low that the driving fluid in the pressure chamber of the cylinder is barely capable of completing the piston stroke, and it may in many cases even be lower, namely when the kinetic energy of the mass set in motion, which is represented by the piston and load taken together, contributes to the completion of the piston stroke.

When thereafter the directional valve 7 is again shifted in order to initiate the next piston stroke, this time towards the left, only the reduced pressure exists in the cylinder chamber A whereas the chamber B takes over the task to serve as a pressure chamber and is supplied with driving fluid at maximum pressure directly from the source 13. The situation then becomes the one illustrated in FIG. 6 all up to the moment, when the actuation of the control cam 4 on the valve 6 ceases, whereupon the situation becomes the one of FIG. 7. Finally, when control cam 4 starts actuating the valve 5 during the final phase of the piston stroke towards the left, the situation becomes the one shown in FIG. 8 all up to the moment, at which the piston is back in its left hand end position shown in FIG. 1, from where the operating cycle is repeated. It is to be noted that the situations illustrated in FIGS. 6, 7, and 8 generally correspond to those of FIGS. 2, 3, and 4, and therefore a more detailed description of these situations is not believed to be needed although, of course, a change of flows caused by the changed direction of stroke will occur, which, however, clearly appears from the figures.

By choosing the moment, at which the driving fluid during each operational stroke starts being supplied to the pressure chamber of the motor with a reduced pressure instead of the driving fluid with the excess pressure of the source, in such a manner that the operational stroke always with certainty will be completed under the conditions prevailing from case to case but with the least possible rest pressure in the pressure chamber at the end of the stroke, an optimum saving of driving fluid is assured. The conditions are dependent on such factors as the size of the mass to be moved by the motor during the stroke in question, the resistance met by this mass on its way, and the "excess pressure" available at the source of driving fluid as compared with the one that is undispensably required for overcoming these resistances and for at the same time accelerating said mass. In many cases the consumption of driving fluid can be reduced to 30–50% of the consumption in a corresponding system of conventional design and this without any substantial reduction of the speed movement during each operational stroke. In certain cases, this speed of movement can even be increased in comparison with the one achievable in such a conventional system, as the pressure difference available for the acceleration of the mass at the moment of starting each operational stroke is the difference between the pressure of the source of driving fluid and the residual pressure in the motor chamber which during the immediately preceding stroke served as pressure chamber. The last-mentioned condition is particularly true in those cases where the working speed of the motor for practical reasons must be limited by means of restrictions such as the one designated by 10, 11 and 12 in the drawings.

Figure 9:
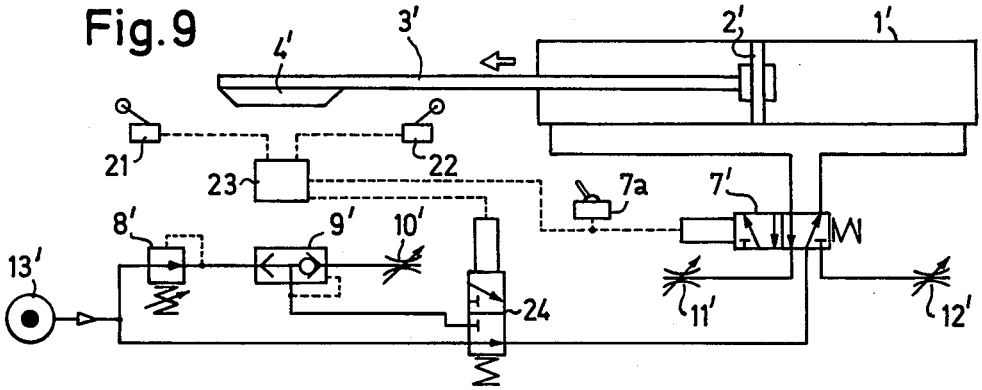
FIG. 9 illustrates a second system embodying the invention in a stage of operation corresponding to the one of the first system illustrated in FIG. 3.

In the system shown in FIG. 9 there is likewise a motor which is illustrated in the form of a double-acting cylinder 1' having a conventional deceleration arrangement of an arbitrary kind in both end positions and having a piston 2', which has a piston rod 3' carrying outside the cylinder housing a control cam 4'. Also in this case the illustrated piston-cylinder-device merely serves as a symbol for any kind of motor, in which a body under the actuation of a compressible driving fluid under pressure is caused to reciprocate along an arbitrary path between two predetermined end positions. In FIG. 9 there is further a directional valve 7', which, however, in this case is assumed to be remotely controlled in an arbitrary, known manner from a control device *7a*, as well as a pressure regulator 8', which is connected to the driving fluid source 13' and is connected in series with a so called quick release valve 9'. Like in the first system previously described the outlet of the last-mentioned valve opens into the atmosphere through a restriction 10', and additional restrictions 11' and 12' are connected to alternatingly active outlets of the valve 7'. Of course, also in this case the changes of positions of the directional valve 7' may, when needed, be made dependent on the strokes of the motor so that the operational strokes automatically follow each other until a control signal interrupts the sequence.

It is to be noted that the quick release valve 9' in the example of FIG. 9 has a somewhat different task than in the preceeding example, namely merely to help the pressure regulator 8' to produce, when needed, a sufficiently rapid pressure drop in the pressure chamber of the motor. The pressure regulator 8, and 8' respectively, may, of course, in a known manner be designed to let out overpressure from its outlet side, in which case the quick release valve 9, and 9' respectively, in certain cases may be dispensed with, particularly if the flows are small. However, even such types of pressure regulators commonly offer only a limited discharge area, which means that the pressure drop will take place too slowly for most practical needs, and, in addition, the design of the pressure regulator is frequently such that a controlled restriction of the overpressure discharge from the outlet side, which is sometimes desirable not the least for the purpose of suppressing noise, cannot take place.

The difference between the system of FIG. 9 and the system of FIGS. 1–8 is mainly that the two valves 5 and 6 have been replaced by two pulse transmitters 21 and 22, which are actuated by the control cam 4' and thus sense the position of the piston, and which transmitters in common through a gate unit 23 of a suitable kind in any known manner, e.g. electrically or pneumatically, control a selector valve 24. This selector valve 24, which is connected before the directional valve 7' provides for an alternative supply of driving fluid either with a higher pressure directly from the source 13' or with a reduced pressure through the pressure regulator 8' and the quick release valve 9' to the directional valve 7'. Thus, in this case all the supply of driving fluid to the motor takes place through the directional valve 7'. The gate unit 23 operates on the one hand in such dependence of the pulse transmitters 21 and 22 that it shifts the selector valve 24 for the supply of low pressure to the directional valve 7' during the final phase of the stroke of the piston 2' in both directions, and on the other hand in such a dependence of the positional changes of the directional valve—in the case shown illustrated by its connection to the control member *7a*—that the selector valve 24 is returned to its initial position shown in order to again supply high pressure fluid to the directional valve 7' as soon as the latter valve changes its position. Like in the first example an optimum pressure drop over the piston 2' during the initial phase of each new piston stroke is thereby assured.

As pointed out hereinbefore, the drawings merely show some examples of the application of the invention, which are in part very simplified and for various reasons frequently require certain modifications for being used in practice. Thus, in many cases, as already indicated in FIG. 9, the use of remote controls of the various valves is to be preferred, in which case e.g. the valves 5 and 6, which in the example of FIGS. 1–8 themselves sense the position of the piston 2 or its equivalent, will be replaced by some suitable kind of piston-position-sensing pulse transmitters and by one or more fluid flow directing valve devices, the operation of which is controlled by the pulses from those transmitters approximately as in FIG. 9. In such a case it is e.g. within the scope of the invention, while maintaining the fluid flow ways shown in FIGS. 1–8, either in a known manner to make the two separate valves 5 and 6 remotely controlled or in a likewise known manner to combine the operation of these two valves in one single, more complexedly designed valve unit. Also other modifications are feasible.

Conclusingly, it is to be pointed out that conduits, valves, and other components in a system of the kind here in question always offer the flowing fluids on the supply side of the motor as well as on the discharge side thereof certain resistances which are not negligible under conditions when the fluid flows more or less temporarily reach high values. This occurs particularly in those cases when the stroke volume of the motor, i.e. the product of stroke and area of the piston or its equivalent, is large and when at the same time the force required for moving the load is considerably less than the one, which the unreduced pressure of the fluid source acting on the piston is capable of producing at the moment when the piston stroke is started. In such cases such a high acceleration of the piston is obtained already in the initial phase of the piston stroke that the pressure in the active pressure chamber rapidly decreases as a result of the fact that the pressure fluid does not reach the pressure chamber at the pace, with which the volume of the pressure chamber is increased. At the same time, as a result of the high acceleration of the piston, a pressure increasy may appear in the return chamber. This is a known effect which may occur both in conventionally designed drive systems and in those embodying the invention, and which must not be confused with the one obtained according to the invention as a result of the conscious, positive and controlled reduction of the pressure in the active pressure chamber during a predetermined finishing part of the operating stroke independently of the operating conditions of the motor. On the other hand, the known effect in combination with an application of the invention will, of course, result in a maximum reduction of the consumption of driving fluid, and for this reason the system should preferably, whenever possible, be so dimensioned that both effects occur simultaneously.

Although the embodiments of the invention, which have hereinbefore been described with reference to the accompanying drawings, presuppose that the motor is of the most common type, in which the motor housing is the stationary member whereas the piston is the movable one connected to the load, it should be readily understood that the invention may equally well be applied if the piston is somehow made stationary whereas the motor housing is the reciprocating member connected to the load. In such a case, of course, the valve means for the supply of driving fluid of different pressures to the motor will have to be governed by the reciprocating housing.

I claim:

1. In a drive system for a pneumatic motor of the kind comprising a housing in which a body is reciprocable between predetermined end positions while dividing the interior of the housing into two chambers alternatingly serving as fluid receiving chambers, the combination of (A) a source of compressible driving fluid under a pressure substantially exceeding the fluid pressure required for driving the motor under its anticipated maximum load, (B) a first fluid supply circuit connected to said source and adapted to deliver fluid therefrom at a first pressure level, (C) a second fluid supply circuit connected to said source and adapted to deliver fluid therefrom at a second pressure level, which is lower than said first pressure level, said second circuit including a pressure reducing valve and a quick release valve connected in series, (D) first valve means for controlling the direction of stroke of said motor, and hence, for selecting the chamber therein to receive the driving fluid, and (E) second valve means operating in dependence of the position of said motor body within said motor housing for connecting the fluid receiving chamber of said motor (i) during an initial phase of each motor stroke to said first fluid supply circuit, and (ii) during a finishing phase of each such stroke to said second fluid supply circuit.

2. A drive system for a pneumatic motor according to claim 1 wherein said second valve means comprise a selector valve remotely controlled by two separate pulse transmitters adapted to detect when said motor body approaches either one of its two end positions within said motor housing.

3. A drive system for a pneumatic motor according to claim 2 wherein said selector valve has an outlet connected to said first valve means.

4. A drive system for a pneumatic motor according to claim 1 wherein said second valve means comprise at least one valve unit controlled by the movements of said motor and connected thereto in a manner to connect the fluid receiving chamber of said motor to said second fluid supply circuit during the finishing phase of each motor stroke independently of said first valve means.

5. In an arrangement for moving loads between two stations the combination of (A) a double-acting motor comprising a housing in which a body is reciprocable between predetermined end positions while dividing the interior of said housing into two chambers adapted to alternatingly receive driving air;

(B) a single source of driving air under a pressure substantially exceeding the air pressure required for accelerating the operating speed of said motor when the same is under its anticipated maximum load;

(C) a first air supply circuit connected to said source and adapted to deliver air therefrom at a first, full pressure level;

(D) a second air supply circuit connected to said source and including a pressure reducing valve for delivering air from said source at a second, reduced pressure level;

(E) first valve means for selecting which one of said two chambers in said motor is to receive driving air and for thus determining the direction of stroke of said double-acting motor;

(F) second valve means controlled by the position of said motor body within said motor housing and operative to connect each motor chamber selected by said first valve means (a) during an initial phase of each motor stroke to said first air supply circuit, and (b) during a finishing phase of each same motor stroke to said second air supply circuit; and (G) means for connecting the chamber in said motor which is opposite to the chamber selected by said first valve means to the atmosphere, whereby the operation of said motor in each of its two directions of operation may be independently controlled.

* * * * *